US010549308B2

(12) United States Patent
Domenighi et al.

(10) Patent No.: US 10,549,308 B2
(45) Date of Patent: Feb. 4, 2020

(54) NOZZLE TIP AND METHOD FOR DISPENSING ONTO A PARTIAL CUT PANEL

(71) Applicant: 3M INNOVATIVE PROPERTIES COMPANY, St. Paul, MN (US)

(72) Inventors: Alvaro S. Domenighi, St. Paul, MN (US); Kim L. Gustafson, Lake Stevens, WA (US); Patrick G. Zimmerman, Mendota Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 183 days.

(21) Appl. No.: 15/548,668

(22) PCT Filed: Mar. 4, 2016

(86) PCT No.: PCT/US2016/020806
§ 371 (c)(1),
(2) Date: Aug. 3, 2017

(87) PCT Pub. No.: WO2016/148937
PCT Pub. Date: Sep. 22, 2016

(65) Prior Publication Data

US 2018/0015495 A1 Jan. 18, 2018

Related U.S. Application Data

(60) Provisional application No. 62/132,810, filed on Mar. 13, 2015.

(51) Int. Cl.
*B05C 1/00* (2006.01)
*B05D 5/10* (2006.01)

(52) U.S. Cl.
CPC ..... *B05C 1/006* (2013.01); *B05D 5/10* (2013.01)

(58) Field of Classification Search
None
See application file for complete search history.

(56) References Cited

U.S. PATENT DOCUMENTS 796,246 A * 8/1905 Printz ..... E04F 21/165 279/93
3,807,351 A 4/1974 Tuberman
(Continued)

FOREIGN PATENT DOCUMENTS

CA 2254295 5/2000
DE 20319881 4/2004
(Continued)

OTHER PUBLICATIONS

International Search Report for PCT International Application No. PCT/US2016/020806, dated May 24, 2016, 4pgs.

*Primary Examiner* — Charles Capozzi
(74) *Attorney, Agent, or Firm* — Philip P. Soo

(57) ABSTRACT

Nozzles are provided, for applying setting resins onto the edge of a partial cut in a panel, in some embodiments a honeycomb panel. The nozzle comprises a connector portion and an application head, wherein the application head comprises: a) a supporting wall, and b) a finish wall joining the supporting wall along an edge at an angle of 90 degrees or greater and less than 120 degrees. In some embodiments, the finish wall has a trailing edge which has a curved profile wherein the curve radius remains between 1.0 and 7.0 cm throughout the curve. In some embodiments, the finish wall has a leading edge which comprises a block wall which at least partially blocks movement of applied resin beyond the leading edge of the finish wall. In addition, methods of applying a setting resin onto the edge of a partial cut in a panel are provided.

13 Claims, 4 Drawing Sheets

(56) References Cited

U.S. PATENT DOCUMENTS

| | | | | |
|---|---|---|---|---|
| 4,378,170 | A | 3/1983 | Orr | |
| 5,250,145 | A | 10/1993 | Despins | |
| 5,471,704 | A * | 12/1995 | Woolley | E04F 21/165 15/105.5 |
| 6,276,858 | B1 | 8/2001 | Kennedy | |
| 2009/0294489 | A1 | 12/2009 | Keohan | |
| 2011/0082432 | A1* | 4/2011 | Fontana | A45D 34/04 604/310 |
| 2012/0091172 | A1 | 4/2012 | Maier | |
| 2012/0180718 | A1* | 7/2012 | Martin | B05C 5/0204 118/108 |

FOREIGN PATENT DOCUMENTS

| | | |
|---|---|---|
| EP | 0250129 | 12/1987 |
| EP | 1749586 | 2/2007 |
| EP | 2896463 | 7/2015 |
| GB | 1026463 | 4/1966 |
| GB | 2352989 | 2/2001 |
| WO | WO 1984-04262 | 11/1984 |
| WO | WO 2007-028857 | 3/2007 |
| WO | WO 2009-009840 | 1/2009 |
| WO | WO 2016-148938 | 9/2016 |
| WO | WO 2016-148991 | 9/2016 |

* cited by examiner

NOZZLE TIP AND METHOD FOR DISPENSING ONTO A PARTIAL CUT PANEL

CROSS REFERENCE TO RELATED APPLICATIONS

This application is a national stage filing under 35 U.S.C. 371 of PCT/US2016/020806, filed 4 Mar. 2016, which claims the benefit of US Provisional Patent Application No. 62/132,810, filed 13 Mar. 2015, the disclosures of which are incorporated by reference in their entirety herein.

FIELD OF THE DISCLOSURE

This disclosure relates to nozzles for applying setting resins onto the edge of a partial cut in a panel and methods of applying setting resins onto the edge of a partial cut in a panel.

BACKGROUND OF THE DISCLOSURE

The following references may be relevant to the general field of technology of the present disclosure: U.S. Pat. Nos. 5,250,145, 6,276,858, US 2009/0294489 A1, and US2012/0091172 A1.

SUMMARY OF THE DISCLOSURE

Briefly, the present disclosure provides nozzles for applying setting resins onto the edge of a partial cut in a panel. The nozzle comprises a connector portion and an application head, wherein the connector portion is adapted to receive setting resin from a resin dispensing device and deliver the setting resin to the application head. The application head comprises: a) a supporting wall, and b) a finish wall joining the supporting wall along an edge at an angle of 90 degrees or greater and less than 120 degrees. The connector portion is adapted to deliver the setting resin to the application head in the interior of the angle formed between the supporting wall and the finishing wall. In some embodiments, the nozzle comprises a single supporting wall. In some embodiments, the nozzle comprises no component which makes contact with the panel other than the supporting wall and the finish wall during application of a setting resin onto the edge of a panel. In some embodiments, the finish wall has a trailing edge which has a curved profile wherein the curve radius remains between 1.0 and 7.0 cm throughout the curve. In some embodiments, the finish wall has a leading edge which comprises a block wall which at least partially blocks movement of applied resin beyond the leading edge of the finish wall. In some embodiments, the finish wall comprises one or more scores enabling reduction in the length of the finish wall by breaking at a score. In some embodiments, the nozzle is a one-piece, integrally formed article. In some embodiments, the nozzle is optically translucent or transparent.

In another aspect, the present disclosure provides methods of applying a setting resin onto the edge of a partial cut in a panel, comprising the steps of: a) bringing the connector portion of a nozzle according to the present disclosure into connection with an output of a resin dispensing device; b) bringing the application head of the nozzle into contact with the edge of a partial cut in a panel; and c) dispensing the setting resin through the nozzle to the partial cut edge of the panel while the nozzle is moved in a lateral direction relative to the panel so as to apply resin to the partial cut edge. In some embodiments, the step of bringing the application head of the nozzle into contact with the edge of a partial cut in a panel comprises positioning the supporting wall of the nozzle plane parallel to and in contact with a top surface layer of the panel. In some embodiments, the step of bringing the application head of the nozzle into contact with the edge of a partial cut in a panel comprises positioning the nozzle such that the angle formed between the supporting wall and the finish wall rides on an outer edge of a top surface layer of the panel. In some embodiments, the panel is a honeycomb panel. In some embodiments, the setting resin is an adhesive. In some embodiments, the setting resin is a low density void filler.

DETAILED DESCRIPTION

This disclosure relates to nozzles for applying setting resins onto the edge of a partial cut in a panel and methods of applying setting resins onto the edge of a partial cut in a panel. Partial cuts may include channel cuts, router cuts, plunge cuts, or any cut that exposes a panel edge without cutting through the entire width of the panel. In some embodiments, a partial cut removes a top surface layer and substantially all of one or more interior layers of the panel, in the area of the cut, while leaving a bottom surface layer intact. In some embodiments, interior layers of the panel are undercut relative to the top surface layer.

Any suitable panels may be used in the practice of the present disclosure. Typically, the panel comprises a top surface layer, at least one core layer, and a bottom surface layer. In some embodiments, the panel comprises a core material which presents voids or ragged or uneven surfaces when cut. In some embodiments, the panel is a honeycomb panel comprising a core layer of honeycomb support material. The honeycomb support material may be of any suitable geometry or material, including standard honeycomb and overexpanded honeycomb. Suitable materials may include metal or alloys, paper or card, plastic resins, fiber, or combinations thereof such as fiberglass or NOMEX® aramid resin-treated paper. In some embodiments, the panel is a foam core panel comprising a core comprising one or more layers of foam material. The surface layers may be single layers or may be comprised of two or more plies. The surface layers may be of any suitable material, which may include one or more of aluminum or other metals or alloys, plastic resins, such as phenolic resin, optionally incorporating glass fibers, aramid fabrics such as KEVLAR®, paper, resin, or veneer.

Figure 3:
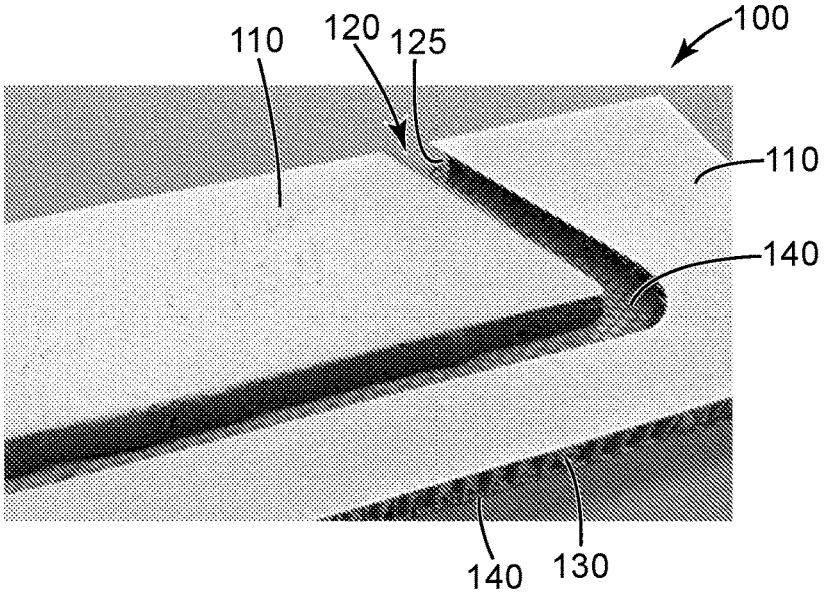
FIG. 3 is a photograph of a partial cut honeycomb panel bearing low density void filler on one cut surface which was applied from a nozzle according to the present disclosure, by a method according to the present disclosure.

FIG. 3 is a photograph of a honeycomb core panel 100 comprising a top surface layer 110. Partial cut 120 exposes bottom surface layer 140 and honeycomb core 130. A setting resin, in this case a low density void filling resin, has been applied to one edge of the partial cut using a nozzle and method of the present disclosure. The resin was allowed to cure in place to form edge fill 150. Partial cut 120 includes undercut 125, where honeycomb core 130 is undercut relative to top surface layer 110.

Any suitable setting resins may be used in the practice of the present disclosure. Suitable materials may include adhesives, including one-part or two-part adhesives, and void filler materials, including low density void fillers.

Figure 1A:
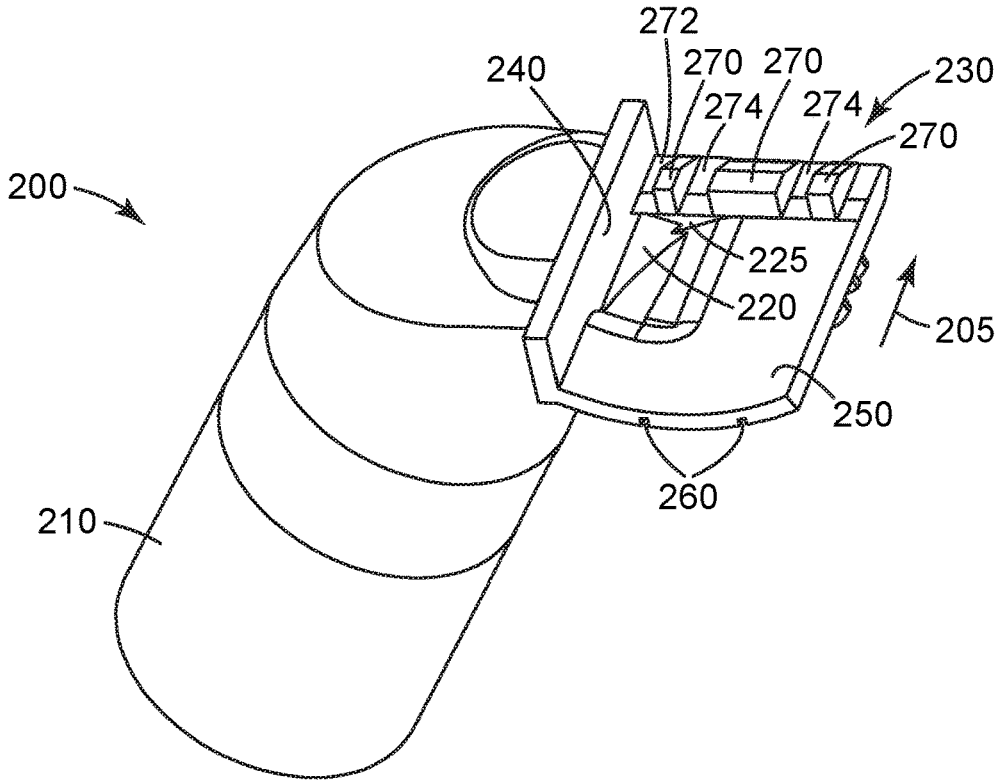
FIGS. 1A, 1B, 1C and 1D are views of a nozzle according to the present disclosure.
Figure 1B:
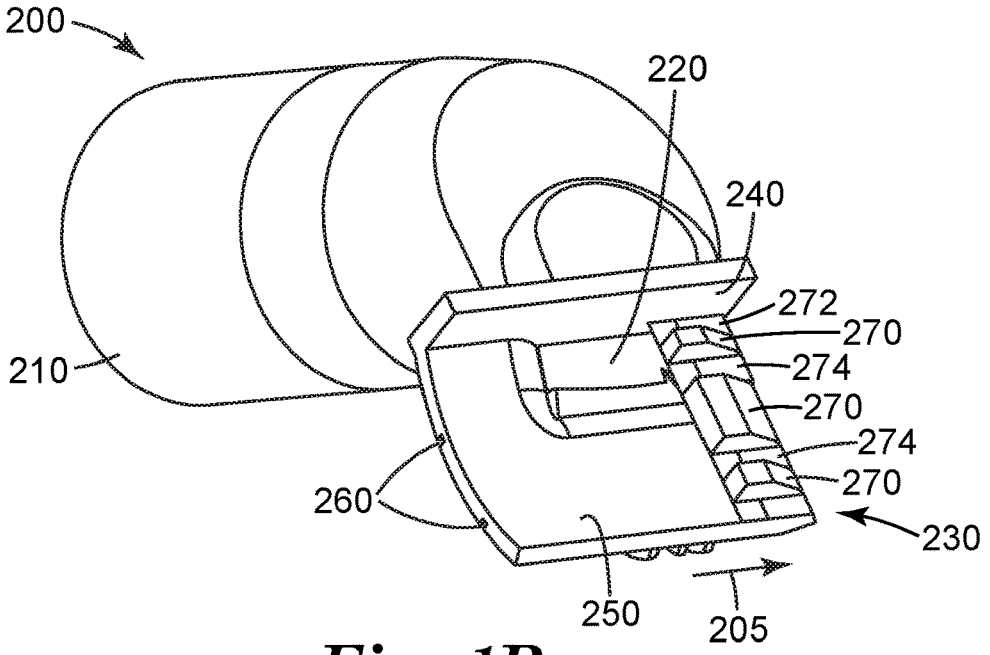
Figure 1C:
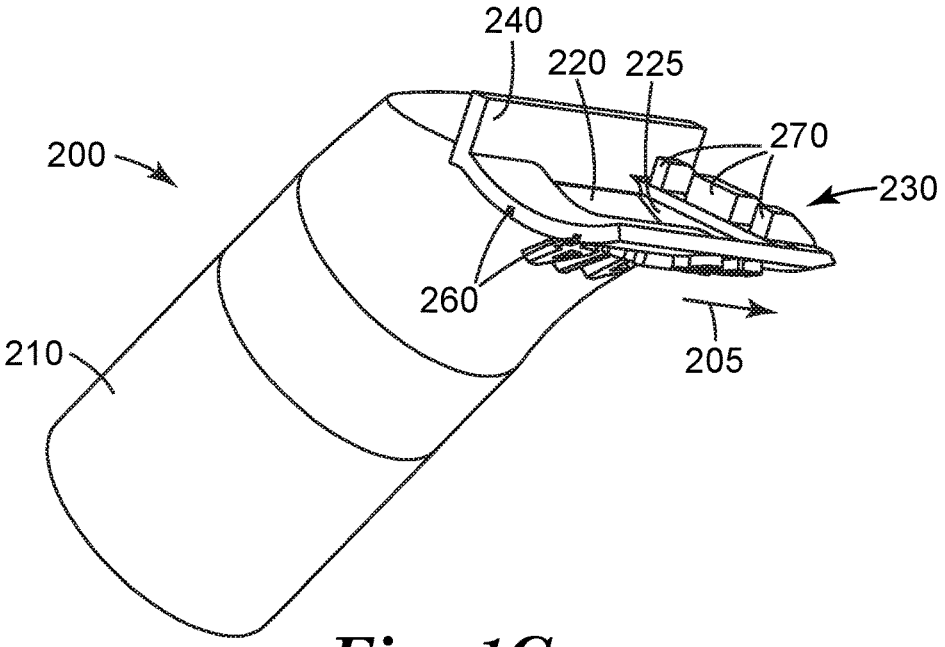
Figure 1D:
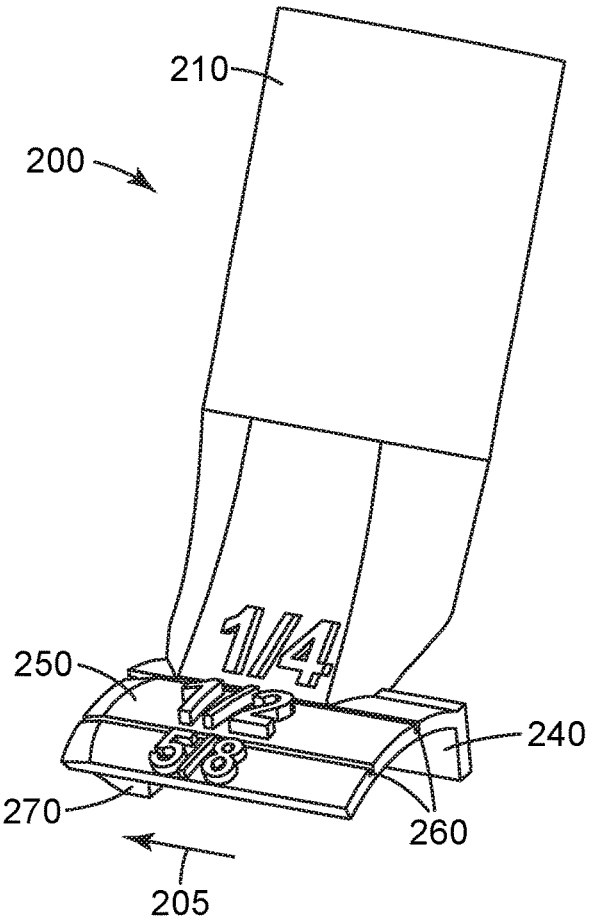
Figure 2A:
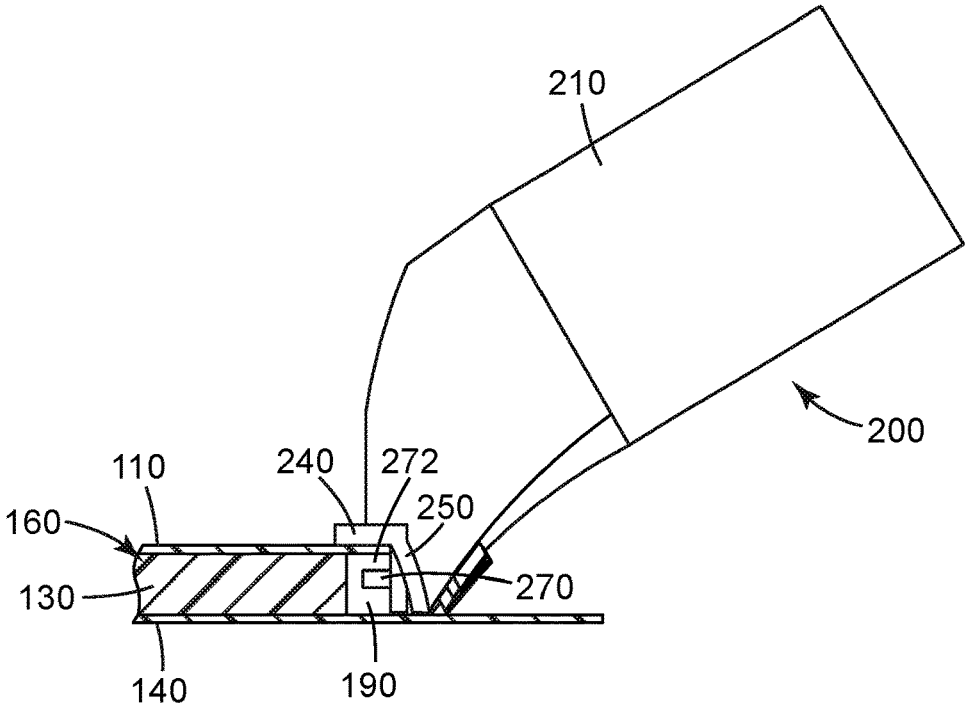
FIGS. 2A, 2B, and 2C are cross sections of nozzles according to the present disclosure positioned for use with three different sizes of partial cut panels.
Figure 2B:
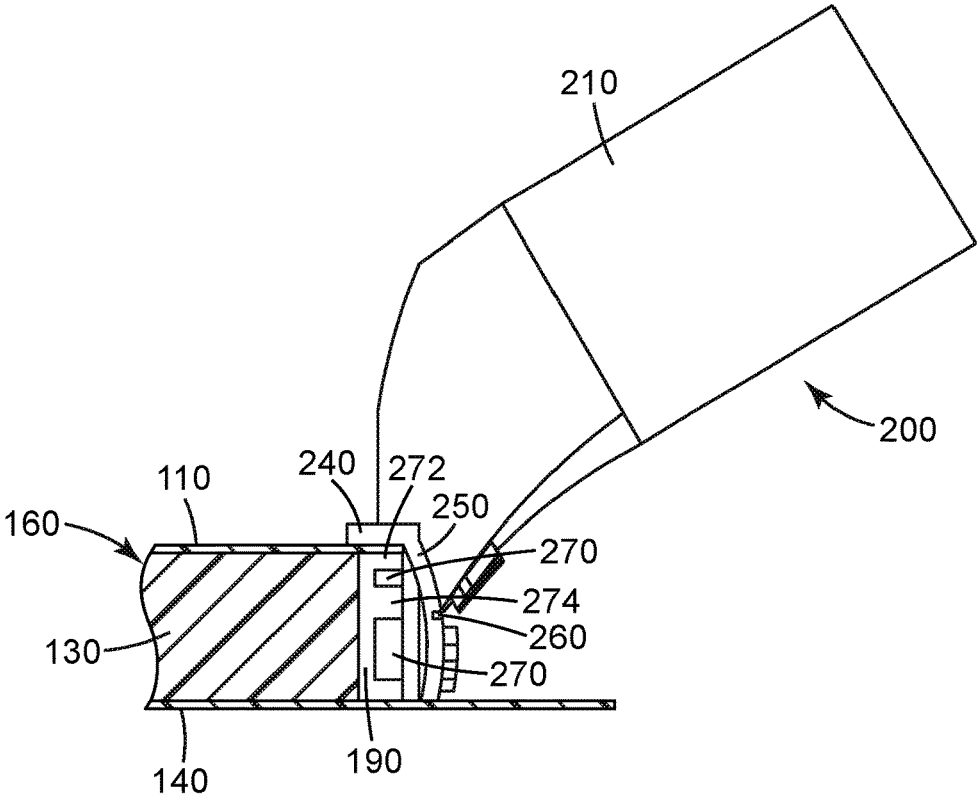
Figure 2C:
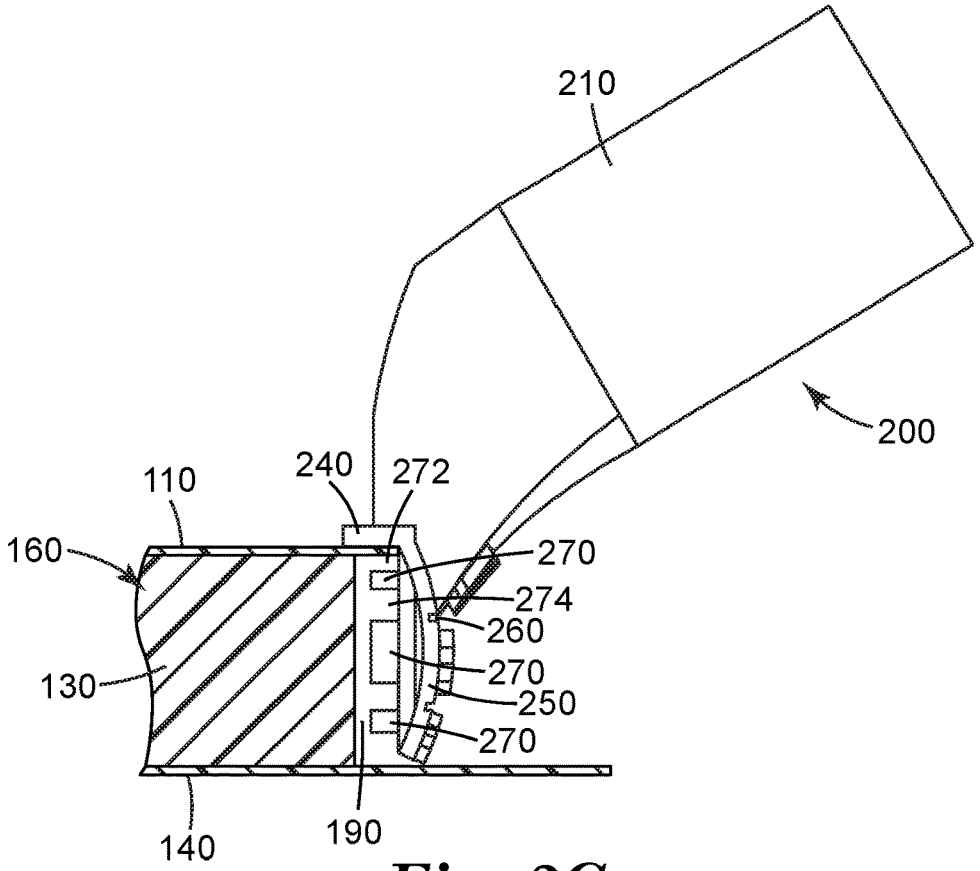

FIGS. 1A-D and FIGS. 2A-C depict certain embodiments of nozzles 200 according to the present disclosure. Arrows 205 represent the direction of movement of the nozzle in use, herein the "lateral axis." In FIGS. 2A-C, the direction of movement of the nozzle in use (the lateral axis) is orthogonal to the page, toward the viewer. The "vertical axis," as used herein, is the axis orthogonal to the panel when the nozzle is positioned next to the panel for use, as depicted in FIGS. 2A-C. FIG. 2A depicts an embodiment of a nozzle 200 according to the present disclosure positioned for use with a partial cut panel 160 ¼" (0.64 cm) in thickness. FIG. 2B depicts an embodiment of a nozzle 200 according to the present disclosure positioned for use with a partial cut panel 170 ½" (1.27 cm) in thickness. FIG. 2C depicts an embodiment of a nozzle 200 according to the present disclosure positioned for use with a partial cut panel 180 ⅝" (1.59 cm) in thickness. Panels 160, 170 and 180 each comprise top surface layer 110, bottom surface layer 140 and honeycomb core 130. In each of FIGS. 2A-C, honeycomb core 130 has been undercut relative to top surface layer 110, leaving gap 190, and bottom surface layer 140 is not cut at the site of the partial cut.

With reference to FIGS. 1A-D and FIGS. 2A-C, nozzles 200 according to the present disclosure comprise connector portion 210 adapted to engage with a setting resin dispensing apparatus (not shown) so as to receive setting resin (not shown). Connector portion 210 may be adapted to engage any suitable setting resin dispensing apparatus. Suitable setting resin dispensing apparatus may include the output of a pump, tube, or gun, or the output of a mixing head. In some embodiments, the mixing head has an outer diameter of 10 or 13 mm, and thus connector portion 210 may have an inner diameter of 10 or 13 mm adapted for friction fit to such an apparatus. In some embodiments, the mixing head has a polygonal profile, and thus connector portion 210 may have a corresponding polygonal profile. In various embodiments, connector portion 210 may be adapted to engage a setting resin dispensing apparatus by friction fit, threaded connection, bayonet mount, or similar mechanism.

Passage 220 allows setting resin (not depicted) to enter application head 230. In some embodiments passage 220 is elongated in the lateral direction to allow for increased resin flow. In some embodiments passage 220 includes curved exit ridge 225 which directs resin entering application head 230 in a direction opposite to the direction of motion of nozzle 200 during use. In some embodiments, passage 220 passes through finish wall 250 of application head 230.

Connector portion 210 may engage application head 230 at any suitable angle. In some embodiments, such as depicted in FIGS. 1A-D and FIGS. 2A-C, connector portion 210 may engage application head 230 at approximately 45 degrees from vertical (relative to the vertical axis) and 90 degrees from lateral (relative to the lateral axis). In some embodiments, connector portion 210 may engage application head 230 at angles of from 0 degrees to 90 degrees from vertical and from 0 degrees to 180 degrees from lateral. In some embodiments adapted to hand application, connector portion 210 engages application head 230 at angles of from 15 degrees to 75 degrees from vertical and from 15 degrees to 165 degrees from lateral. In some embodiments adapted to automated application, connector portion 210 engages application head 230 at angles of from 0 degrees to 45 degrees from vertical and from 45 degrees to 135 degrees from lateral.

Application head 230 comprises supporting wall 240. In use, supporting wall 240 is plane parallel to and rides on top surface layer 110 to provide contact, alignment and support of nozzle 200. Supporting wall 240 joins with finish wall 250 along an edge to form an angle which rides on the outer edge of top surface layer 110 to provide additional contact, alignment and support of nozzle 200. In typical embodiments, "supporting wall" means a nozzle component which, when the nozzle is in use to apply resin to a panel, may be in contact with and plane parallel to a portion of the panel. In some embodiments, "supporting wall" may mean a nozzle component which, when the nozzle is in use to apply resin to a panel, may form an angle with finish wall 250 which angle rides on an outer edge of the panel. In some embodiments, application head 230 comprises a single supporting wall 240; i.e., no more than one supporting wall 240. In some embodiments, application head 230 comprises no component other than finish wall 250 which, during use, makes contact with the bottom surface layer. In some embodiments, application head 230 comprises no component which, during use, makes contact with the panel other than supporting wall 240 and finish wall 250.

In some embodiments, such as depicted FIGS. 1A-D and FIGS. 2A-C, the trailing edge of finish wall 250 is smoothly curved toward the panel so as to provide a smoothly curved finish in the applied resin (not shown) after application. In some embodiments, the curve radius of the trailing edge of finish wall 250 is constant, while in other embodiments the curve radius of the trailing edge of finish wall 250 varies over the length of the trailing edge. In some embodiments, the curve radius of the smoothly curving trailing edge of finish wall 250 remains between 1.0 and 7.0 cm throughout the curve, in some embodiments between 1.5 and 7.0 cm, in some embodiments between 1.5 and 5.0 cm, and in some embodiments between 1.5 and 3.0 cm. As used herein, "curve radius" refers to the inner face of curved finish wall 250 and is measured for a curve existing in a plane orthogonal to the lateral axis. In some embodiments, supporting wall 240 joins finish wall 250 along an edge at a right angle. In other embodiments (not shown), the trailing edge of finish wall 250 may be straight, so as to provide a flat finish in the applied resin (not shown) after application. In some embodiments, such as depicted FIGS. 1A-D and FIGS. 2A-C, supporting wall 240 joins finish wall 250 along an edge at an angle of 90 degrees or greater, in some embodiments greater than 92 degrees, and in some embodiments greater than 94 degrees. In some embodiments, supporting wall 240 joins finish wall 250 along an edge at an angle of 90 degrees or greater and less than 120 degrees; in some embodiments greater than 92 degrees and less than 120 degrees, and in some embodiments greater than 94 degrees and less than 120 degrees. In some embodiments, finish wall 250 includes scoring 260 enabling the user to break off distal portions of finish wall 250 so as to use nozzle 200 with thinner panels. In the embodiment depicted in FIGS. 1A-D and FIGS. 2A-C, nozzles 200 are scored for use with ¼" (0.64 cm) panels, as depicted in FIG. 2A, or ½" (1.27 cm) panels, as depicted in FIG. 2B, or may be used as is with ⅝" (1.59 cm) panels, as depicted in FIG. 2C. The length of finish wall 250, measured along the vertical axis from the angle formed between finish wall 250 and supporting wall 240 to the end of finish wall 250, is approximately the same as the combined width of the top surfaced layer and the core of the panel.

In some embodiments, such as depicted in FIGS. 1A-D and FIGS. 2A-C, the leading edge of finish wall 250 includes block wall 270 to discourage movement of applied resin beyond the leading edge of finish wall 250. In some embodiments, the leading side of block wall 270 is angled to minimize interference with core material such as honeycomb core 130. In some embodiments, the height of block wall 270 is less than the undercut of core material such as honeycomb core 130 to avoid contact with core material. Block wall 270 contains gap 272 to provide room for top surface layer 110. In some embodiments block wall 270 also contain gaps 274 corresponding to scoring 260.

The nozzles according to the present disclosure may be made of any suitable material. Suitable materials may include ceramics, metals or plastic resins, such resins potentially including ABS, acrylics, polyetheramides such as ULTEM™, and optionally incorporating fibers or fillers. In some embodiments the nozzle material is optically clear or translucent so as to allow observation of the setting resin within the nozzle during preparation, use, and cleaning. The nozzles according to the present disclosure may be made by any suitable process. Suitable processes may include machining, additive processes such as 3D printing, molding processes such as injection molding. In some embodiments, the nozzles according to the present disclosure are one-piece, integrally formed articles. In some embodiments, the nozzles according to the present disclosure are integrally formed with or permanently attached to setting resin dispensing apparatus.

With reference to FIGS. 2A-C, in a method according to the present disclosure, connector portion 210 of a nozzle 200 according to the present disclosure is brought into connection with the output of a resin dispensing device (not shown). Application head 230 of nozzle 200 is brought into contact with the edge of a partial cut in panel 160, 170, or 180 such that supporting wall 240 is plane parallel to and rides on top surface layer 110 to provide contact, alignment and support of nozzle 200, or such that the angle formed between supporting wall 240 and finish wall 250 rides on the outer edge of top surface layer 110 to provide contact, alignment and support of nozzle 200, or both. Setting resin (not shown) is dispensed from the resin dispensing device through nozzle 200 to the partial cut edge of panel 160, 170, or 180 while the nozzle is moved in the lateral direction relative to the panel so as to apply resin to the partial cut edge. It is to be understood that motion of the nozzle relative to the panel may be achieved by motion of the nozzle, motion of the panel, or both. The setting resin is allowed or caused to set. Dispensing of the resin may be motivated by any suitable method, including manual and mechanical methods, and controlled by any suitable methods, including human or automated methods. Support and motion of the panel and nozzle may be accomplished by any suitable methods, including manual and mechanical methods, and controlled by any suitable methods, including human or automated methods.

Various modifications and alterations of this disclosure will become apparent to those skilled in the art without departing from the scope and principles of this disclosure, and it should be understood that this disclosure is not to be unduly limited to the illustrative embodiments set forth hereinabove.

We claim:

1. A nozzle for application of a setting resin onto the edge of a partial cut in a panel, the nozzle comprising a connector portion and an application head, wherein the connector portion is adapted to receive setting resin from a resin dispensing device and deliver the setting resin to the application head, and wherein the application head comprises:

a) a supporting wall, and b) a finish wall joining the supporting wall along an edge at an angle of 90 degrees or greater and less than 120 degrees, wherein the connector portion is adapted to deliver the setting resin to the application head in the interior of the angle formed between the supporting wall and the finish wall, and wherein the finish wall has a block wall extending along a leading edge of the finish wall to at least partially block movement of applied resin beyond the leading edge, the block wall including a gap adjacent to a top surface of the panel when the nozzle is in use.

2. The nozzle according to claim 1 which comprises a single supporting wall.

3. The nozzle according to claim 1 wherein, during application of a setting resin onto the edge of a partial cut in a panel, the nozzle comprises no component which makes contact with the panel other than the supporting wall and the finish wall.

4. The nozzle according to claim 1 wherein the finish wall has a trailing edge which has a curved profile wherein the curve radius remains between 1.0 and 7.0 cm throughout the curve.

5. A nozzle for application of a setting resin onto the edge of a partial cut in a panel, the nozzle comprising a connector portion and an application head, wherein the connector portion is adapted to receive setting resin from a resin dispensing device and deliver the setting resin to the application head, and wherein the application head comprises:

a) a supporting wall, and b) a finish wall joining the supporting wall along an edge at an angle of 90 degrees or greater and less than 120 degrees, wherein the connector portion is adapted to deliver the setting resin to the application head in the interior of the angle formed between the supporting wall and the finish wall, and wherein the finish wall comprises one or more scores enabling reduction in the length of the finish wall by breaking at a score.

6. The nozzle according to claim 1 wherein the nozzle is a one-piece, integrally formed article.

7. The nozzle according to claim 1 wherein the nozzle is optically translucent or transparent.

8. A method of applying a setting resin onto the edge of a partial cut in a panel, comprising the steps of:

a) bringing the connector portion of the nozzle according to claim 1 into connection with an output of the resin dispensing device;

b) bringing the application head of said nozzle into contact with the edge of the partial cut in the panel; and c) dispensing the setting resin through the nozzle to the partial cut edge of the panel while the nozzle is moved in a lateral direction relative to the panel so as to apply resin to the partial cut edge.

9. The method according to claim 8 wherein the step of bringing the application head of said nozzle into contact with the edge of the partial cut in the panel comprises positioning the supporting wall of the nozzle plane parallel to and in contact with a top surface layer of the panel.

10. The method according to claim 8 wherein the step of bringing the application head of said nozzle into contact with the edge of the partial cut in the panel comprises positioning the nozzle such that the angle formed between the supporting wall and the finish wall rides on an outer edge of a top surface layer of the panel.

11. The method according to claim 8 wherein the panel is a honeycomb panel.

12. The method according to claim 8 wherein the setting resin is an adhesive.

13. The method according to claim 8 wherein the setting resin is a void filler.

* * * * *